US006758544B2

(12) United States Patent
Fukano

(10) Patent No.: US 6,758,544 B2
(45) Date of Patent: Jul. 6, 2004

(54) INK JET PRINTER

(75) Inventor: Takakazu Fukano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/123,531

(22) Filed: Apr. 17, 2002

(65) Prior Publication Data

US 2002/0158926 A1 Oct. 31, 2002

(30) Foreign Application Priority Data

Apr. 17, 2001 (JP) ..... P2001-118741
Apr. 10, 2002 (JP) ..... P2002-108143

(51) Int. Cl.[7] ..... B41J 29/38
(52) U.S. Cl. ..... 347/9; 347/10; 347/11
(58) Field of Search ..... 347/9, 10, 11, 347/43, 68, 69

(56) References Cited

U.S. PATENT DOCUMENTS 5,907,331 A * 5/1999 Markham ..... 347/12
6,003,971 A 12/1999 Hanks et al.
6,012,799 A * 1/2000 Silverbrook ..... 347/43
6,328,395 B1 * 12/2001 Kitahara et al. ..... 347/9

FOREIGN PATENT DOCUMENTS

EP 0827838 A2 * 11/1998
EP 1 057 632 A2 12/2000
EP 1 088 662 A2 4/2001
JP 10-81013 3/1998
JP 10-193587 7/1998

* cited by examiner

*Primary Examiner*—Hai Pham
*Assistant Examiner*—Lam Nguyen
(74) *Attorney, Agent, or Firm*—Sughrue Mion, PLLC

(57) ABSTRACT

In an ink jet printer, a control unit converts externally provided printing data into jetting data associated with a size of dot to be printed. A drive signal generator generates a drive signal including a plurality of drive pulses. In a printing head, a pressure chamber is communicated with a nozzle. A pressure generating element varies pressure inside of the pressure chamber when at least one of the drive pulses is applied. A decoder decodes the jetting data into pulse select information in accordance with a predetermined conversion relationship. A switcher selects at least one of the drive pulses to be applied to the pressure generating element in accordance with the pulse select information. Pattern data defines the conversion relationship. A common signal line transfers the jetting data and the pattern data from the control unit to the printing head.

11 Claims, 7 Drawing Sheets

| SI (H L) | DP1 | DP2 | DP3 | DP4 | DECODED DATA |
|---|---|---|---|---|---|
| 1 (00) | × | × | × | ○ | (0001) |
| 2 (01) | × | ○ | × | × | (0100) |
| 3 (10) | ○ | × | × | × | (1000) |
| 4 (11) | ○ | × | ○ | × | (1010) |

| | (H L) | DP1 | DP2 | DP3 | DP4 | DECODED DATA | JETTED INK AMOUNT |
|---|---|---|---|---|---|---|---|
| SICL | 1 (00) | × | × | × | ○ | (0001) | 0PL |
| | 2 (01) | × | ○ | × | × | (0100) | 6PL |
| | 3 (10) | ○ | × | × | × | (1000) | 13PL |
| | 4 (11) | ○ | × | ○ | × | (1010) | 26PL |
| SIBK | 00 | × | × | × | ○ | (0001) | 0PL |
| | 01 | × | × | ○ | × | (0100) | 13PL |
| | 10 | ○ | × | × | × | (1000) | 13PL |
| | 11 | ○ | × | ○ | × | (1010) | 26PL |

INK JET PRINTER

BACKGROUND OF THE INVENTION

The present invention generally relates to an ink jet printer capable of jetting ink droplets having different sizes from the same nozzle. More specifically, the present invention is directed to such an ink jet printer capable of jetting a plurality of ink droplets during a single printing time period.

As output apparatus of computers, color ink jet printers have been popularized in which several colors of ink are jetted from printing heads. To print out images processed by computers and the like in multi-color multi-gradation modes, these color ink jet printers have been widely employed.

An ink jet printer contains a printing head equipped with a large number of nozzles arranged in a sub-scanning direction (namely, paper feeding direction). While this printing head is moved by a carriage mechanism along a main scanning direction, a predetermined paper feeding operation is carried out along the above-described sub-scanning direction, so that a desirable print result is obtained. Based upon dot pattern data generated by converting printing data supplied from a host computer, ink droplets are jetted from the respective nozzles of the printing head at preselected timing. Then, the respective ink droplets are impacted onto a recording medium such as recording paper, and are adhered thereon, so that a printing operation is carried out. As previously described, since the ink jet printer determines as to whether or not the ink droplets are jetted, namely executes ON/OFF controls of dots, this ink jet printer cannot directly print out half-tone gradation such as a gray color.

Under such a circumstance, there have been utilized ink jet printers capable of controlling variably diameters of recording dots in such a manner that a plurality of ink droplets having different ink weights are jetted from the same nozzle. For instance, in such an ink jet printer described in Japanese Patent Publication No. 10-81013A, while a drive signal which is outputted every one printing time period is constituted by a plurality of drive pulses, at least one of drive pulses is selected based upon such printing data containing pulse selection signals corresponding to the respective drive pulses. In other words, in the related ink jet printer described in the publication, for example, the drive signal outputted every one printing time period is constituted by four drive pulses made of a first pulse (middle dot), a second pulse (small dot), a third pulse (middle dot), and a fourth pulse (meniscus vibration). While 1-bit data is allocated with respect to each of these drive pulses, jetting data is constructed. Then, in the case that a gradation value "1" of non-dot is realized, "0" is applied to a switcher for a time period during which the first to third pulses are generated. On the other hand, "1" is applied to the switcher in synchronism with the generation of the fourth pulse in order that only the fourth pulse for vibrating a meniscus of ink in the nozzle is applied to a piezoelectric vibrator. As a result, the gradation value "1" of the non-dot may be realized in which an ink droplet is not jetted. To this end, after the 2-bit data (00) indicative of the gradation value 1 has been decoded into the 4-bit data (0001) by a decoder, the decoded 4-bit data is applied to the above-described switcher.

Similarly, in the case that the gradation value 2 of the small dot is realized, "0" is applied to the switcher for a time period during which the first pulse, the third pulse, and the fourth pulse are generated. On the other hand, when "1" is applied to the switcher in synchronism with the generation of the second pulse, only the second pulse is applied to the piezoelectric vibrator, so that the gradation value 2 can be realized by which the ink droplets equivalent to the small dot are jetted. In this case, after 2-bit data (01) indicative of the gradation value 2 is decoded into 4-bit data (0100) by the decoder, the decoded 4-bit data is applied to the above-explained switcher.

Similarly, in the case that the gradation value 3 of one middle dot is realized, "0" is applied to the switcher for a time period during which the second pulse, the third pulse, and the fourth pulse are generated. On the other hand, when "1" is applied to the switcher in synchronism with the generation of the first pulse, only the first pulse is applied to the piezoelectric vibrator, so that the gradation value 3 can be realized by which the ink droplets equivalent to the middle dot are jetted. In this case, after 2-bit data (10) indicative of the gradation value 3 is decoded into 4-bit data (1000) by the decoder, the decoded 4-bit data is applied to the above-explained switcher.

Similarly, in the case that the gradation value 4 of two middle dots is realized, "0" is applied to the switcher for a time period during which the second pulse, and the fourth pulse are generated. On the other hand, when "1" is applied to the switcher in synchronism with the generations of the first and third pulses, only the first and third pulses are applied to the piezoelectric vibrator, so that the gradation value 4 can be realized by which the ink droplets equivalent to the middle dot are jetted two times. In this case, these ink droplets are continuously impacted onto the recording paper, and these ink droplets are mixed with each other, so that actually one large dot may be formed. Accordingly, the gradation value 4 can be realized. In this case, after 2-bit data (11) indicative of the gradation value 4 is decoded into 4-bit data (1010) by the decoder, the decoded 4-bit data is applied to the above-explained switcher.

On the other hand, in a head drive circuit mounted in the printing head of the ink jet printer, transmission gates (will be referred to as "TG" hereinafter) are provided in correspondence with every nozzle row used to jet each of the color ink droplets, while these TGs are constructed of switchers used to supply drive signals to the piezoelectric vibrators.

In order to execute the above-described dot gradation, for example, 2-bit gradation (multi-gradation) data (00, 01, 10, 11) SI is required to be decoded into such a pulse selection signal which is made of 4-bit data (0001, 0100, 1000, 1010). Thus, both this 2-bit gradation data (jetting data) SI and program data (pattern data) SP for executing this decoding must be supplied to the switcher (TG) incorporated in the printing head.

In the related ink jet printer, the jetting data (00, 01, 10, 11) SI is supplied from a control unit incorporated in a printer main body into the switcher (TG) incorporated in the printing head with respect to each of the color nozzle rows (each of color TGs). On the other hand, as to the program data (pattern data) SP, commonly-used patterns are supplied to all of the color nozzle rows (each of color TGs).

In the related ink jet printer, since the jetting data SI for each of these color nozzle rows (namely, respective color TGs) is supplied to the switcher (TG) incorporated in the printing head from the control unit of the printer main body, signal lines for the jetting data SI for each of these color nozzle rows (respective color TGs) are required within an FFC (Flexible Flat Cable) which electrically connects the printer main body to the printing head. Furthermore, at least one signal line for the pattern data SP is required in this FFC.

To achieve higher printing speeds and also higher image qualities in ink jet printers, the following measure may be conceived. That is, nozzle rows (TGs) for the respective colors incorporated in printing heads are increased. As explained above, when a plurality of ICs (TGs) are mounted on the printing heads, a plurality of signal lines are furthermore required in correspondence with these plural ICs.

However, a plurality of such signal lines are required within the FFC, so that the width of this FFC would be widened, and thus, wire routing works would become difficult. In addition, since such signal lines are provided with respect to each of these TGs, if a total number of TGs is increased, then manufacturing cost thereof is accordingly increased.

Also, in the related ink jet printer, as to the program data (pattern data) SP, the commonly-used patterns are supplied to all of the color nozzle rows (respective color TGs). As a result, it is practically difficult to control the ink jetting amounts for the respective colors within a single printing time period, for instance, it is practically difficult to make the monochrome dot gradation pattern different from the color dot gradation pattern.

SUMMARY OF THE INVENTION

It is therefore a first object of the present invention to provide an ink jet printer capable of representing multi-gradations by using both jetting data and pattern data, and also capable of being manufactured in relatively low cost as well as realizing easy wire routing works of an FFC by reducing a total number of signal lines connected between a printer main body and a printing head.

A second object of the present invention is to provide such an ink jet printer capable of realizing a high-density printing operation and also a printing operation with a high image quality by controlling ink jetting amounts of respective colors within a single printing time period, for instance, by making monochrome dot gradation pattern different from color dot gradation pattern.

A third object of the present invention is to achieve the second object without increasing a total number of signal lines incorporated in the FFC.

In order to achieve the above objects, according to the present invention, there is provided an ink jet printer, comprising:

- a control unit, which converts externally provided printing data into jetting data associated with a size of dot to be printed;
- a drive signal generator, which generates a drive signal including a plurality of drive pulses;
- a printing head, which includes:
  - a pressure chamber communicated with a nozzle;
  - a pressure generating element, which varies pressure inside of the pressure chamber when at least one of the drive pulses is applied;
  - a decoder, which decodes the jetting data into pulse select information in accordance with a predetermined conversion relationship; and
  - a switcher, which selects at least one of the drive pulses to be applied to the pressure generating element in accordance with the pulse select information;
- pattern data, which defines the conversion relationship; and
- a common signal line, which transfers the jetting data and the pattern data from the control unit to the printing head.

Preferably, the pattern data is made continuous with the jetting data.

According to the present invention, there is also provided an ink jet printer, comprising:

- a control unit, which converts externally provided printing data into jetting data associated with a size of dot to be printed;
- a drive signal generator, which generates a drive signal including a plurality of drive pulses;
- a printing head, which includes:
  - at least two nozzle rows, each associated with at least one color of ink and including a plurality of nozzles each communicated with a pressure chamber;
  - a pressure generating element, which varies pressure inside of the pressure chamber when at least one of the drive pulses is applied;
  - a decoder, which decodes the jetting data into pulse select information in accordance with a predetermined conversion relationship; and
  - a switcher, which selects at least one of the drive pulses to be applied to the pressure generating element in accordance with the pulse select information; and
- at least two pattern data, each associated with at least one color of ink different from one another and each defining the conversion relationship.

Preferably, the pattern data is made continuous with the jetting data.

Preferably, the ink jet printer further comprises a common signal line, which transfers the jetting data and the pattern data from the control unit to the printing head.

Preferably, the drive signal includes a first drive pulse associated with a first amount of jetted ink, a second drive pulse associated with a second amount of jetted ink which is less than the first amount, and a third drive pulse associated with the first amount of jetted ink. Here, at least one of the plural dot pattern data is so constructed as to select either one of the first drive pulse and the third drive pulse within a unit printing time period.

In the above configurations, since the pattern data is transferred by way of the signal line which is commonly used with the jetting data from the control unit to the printing head, such a signal line used to transfer the pattern data need not be separately provided. As a consequence, for instance, a total number of signal lines incorporated in the FFC can be reduced. While the ink jet printer can be manufactured in relatively low cost, wire routing works of this FFC can be easily made.

In addition, as to at least one color, since such pattern data which is different from that of another color is employed, the programmable ink jetting control operation can be carried out in the ink jet printer, for instance, the resolution of this relevant one color may be made different from the resolution of another color.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to the accompanying drawings, preferred embodiments of the present invention will be described in detail. First, a description is made of an ink jet printer according to a first embodiment of the present invention.

Figure 1:
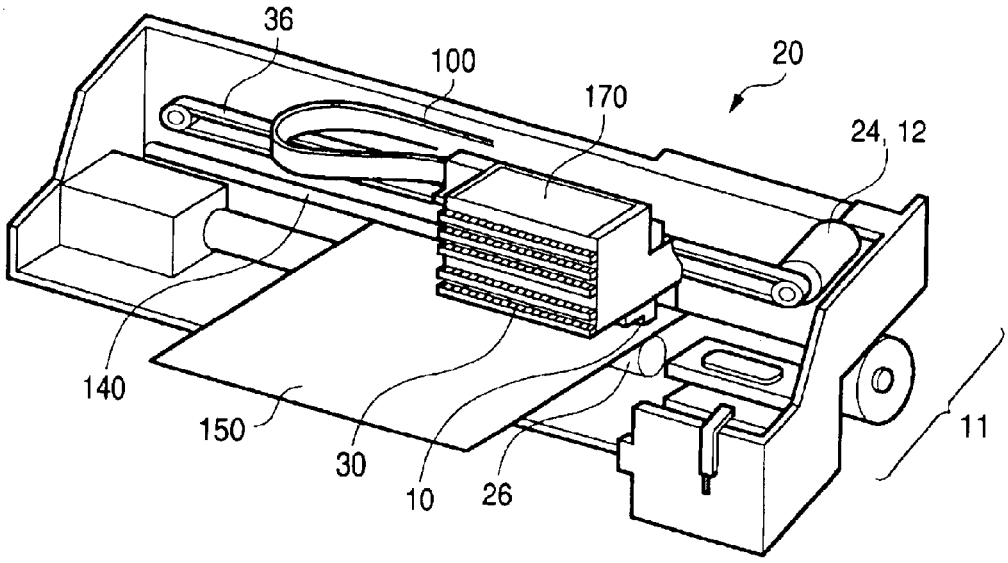
FIG. 1 is a schematic perspective view showing the whole configuration of an ink jet printer incorporating the present invention.

As indicated in FIG. 1, an ink jet printer 20 according to this first embodiment is arranged in such a manner that a carriage 30 is connected via a timing belt 36 to a carriage motor 24 of a carriage mechanism 12, and while the carriage 30 is guided by a guide member 140, this carriage 30 is moved in a reciprocation manner along a paper width direction of printing paper 150. Also, in this ink jet printer 20, a paper feeding mechanism 11 using a paper feeding roller 20 is also provided. An ink jet printing head 10 is mounted on a plane opposite to the printing paper 150, namely a lower face of the carriage 30. While the printing head 10 receives ink supplied from an ink cartridge 170 which is mounted on an upper portion of the carriage 30, this printing head 10 jets ink droplets of the respective colors onto the printing paper 150 in conjunction with the transport of the carriage 30 so as to form dots, so that the printing head 10 prints out an image and a character on the printing paper 150.

Figure 2:
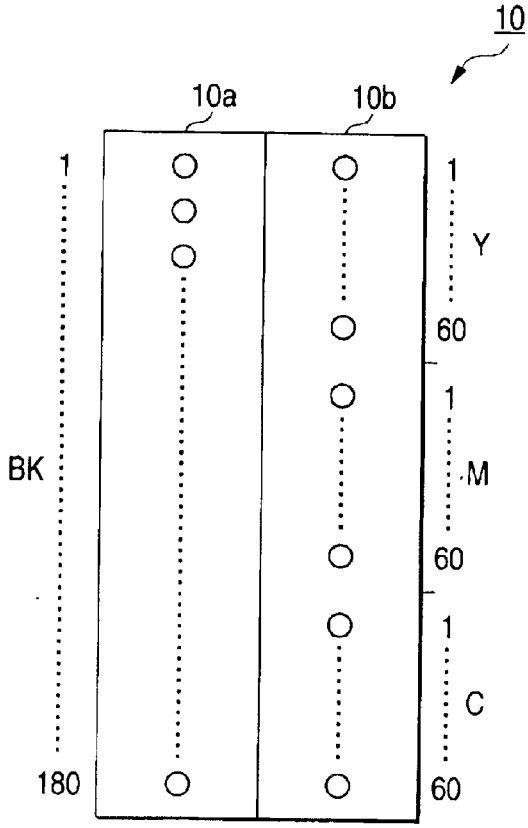
FIG. 2 is a diagram for illustratively showing nozzle rows formed on a printing head of the ink jet printer.

It should be noted that in this embodiment, as indicated in FIG. 2, the printing head 10 is formed with two nozzle rows, namely a nozzle row 10BK for jetting black ink, and also, a nozzle row 10CL for jetting color ink (CL). The nozzle row 10BK contains 180 sets of nozzles along a longitudinal direction (sub-scanning direction), whereas the nozzle row 10CL contains 60 sets of nozzles for yellow (Y), 60 sets of nozzles for magenta (M) ink, and 60 sets of nozzles for cyan (C) ink along the longitudinal direction (sub-scanning direction) in this order. In this case, as indicated in FIG. 1, the printing head 10 is connected via a flexible flat cable (Flexible Flat Cable: will be referred to as an "FFC" hereinafter) 100 with respect to a main body (circuit) of the printer 20. As this FFC 100, such a flexible flat cable having a relatively long length may be incorporated in order not to disturb the transport of the carriage 30.

Figure 3:
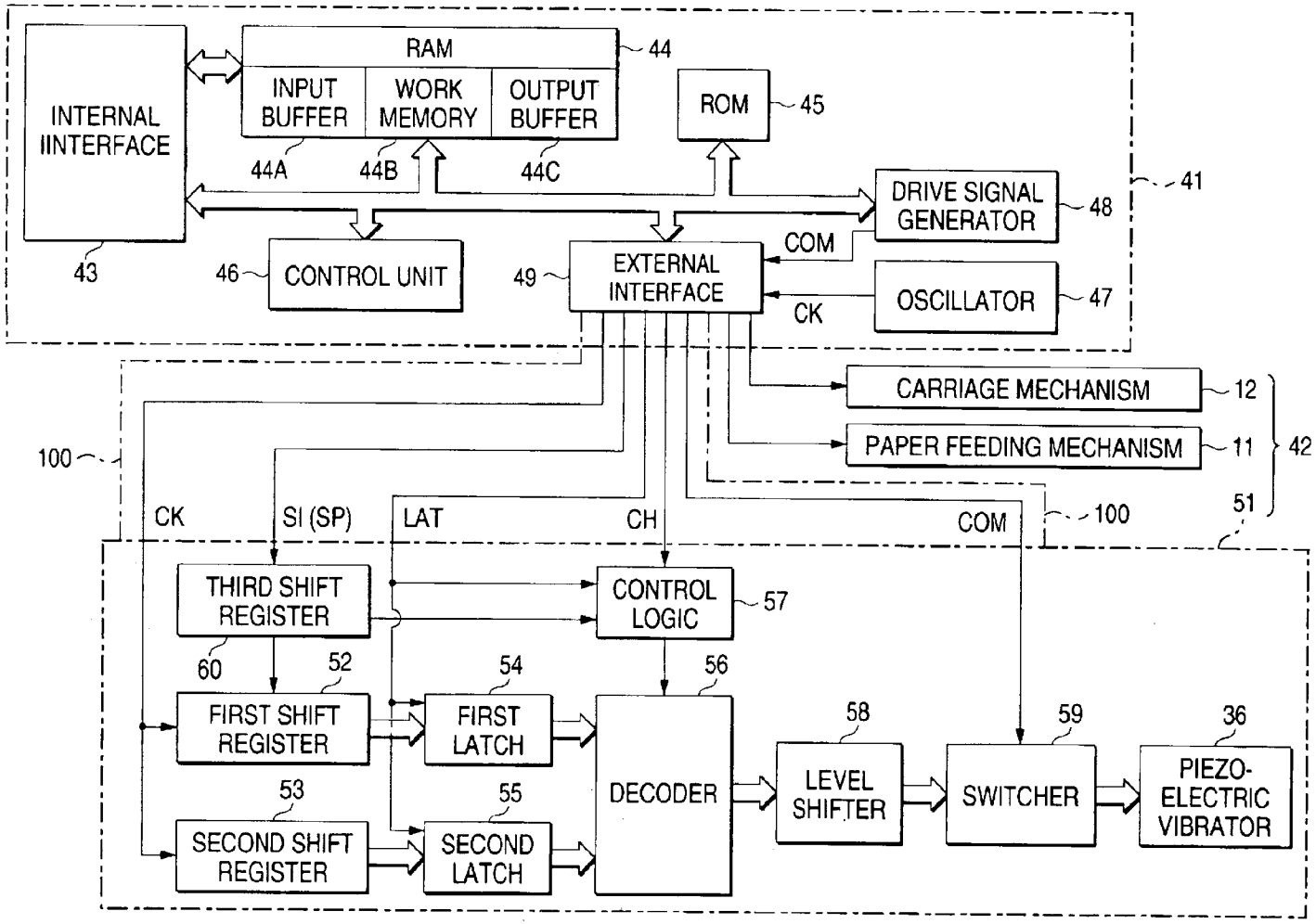
FIG. 3 is a functional block diagram of the ink jet printer.

Next, a description will now be made of an electric arrangement of the above-explained ink jet printer 20. As shown in FIG. 3, this ink jet printer 20 is provided with a printer controller 41 and a print engine 42.

The printer controller 41 is provided with an interface (will be referred to as an "external I/F" hereinafter) 43, a RAM (random access memory) 44, a ROM (read-only memory) 45, a control unit 46, an oscillator 47, a drive signal generator 48, and another interface (will be referred to as an "internal I/F" hereinafter) 49. The external I/F 43 receives printing data and the like, which are supplied from a host computer (not shown). The RAM 44 stores thereinto various sorts of data. The ROM 45 previously stores thereinto a routine and the like used to process various sorts of data. The control unit 46 is constituted by a CPU (central processing unit) and the like. The oscillator 47 oscillates a clock signal (CK). The drive signal generator 48 generates a drive signal (COM) which is supplied to the printing head 10. Also, the internal I/F 49 is used to transmit jetting data SI, program (pattern) data SP, a drive signal, and the like, which will be explained more in detail, to the print engine 42.

Figure 4A:
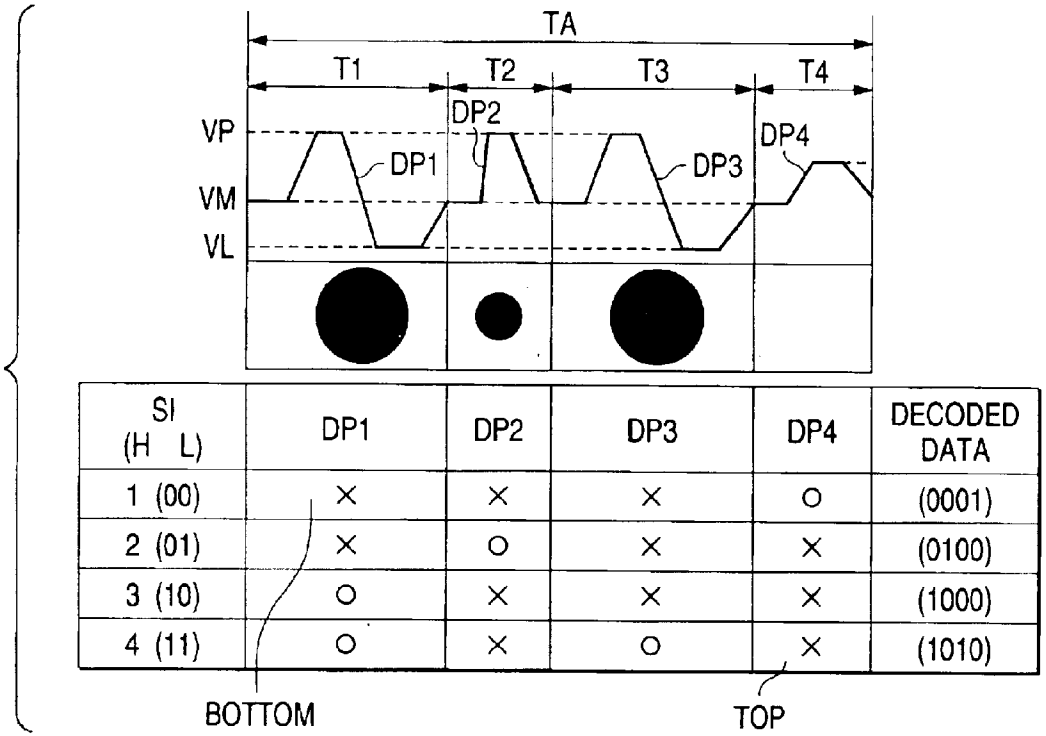
FIGS. 4A and 4B are diagrams for explaining a relationship among drive signals (pulses) jetting data, and program (pattern) data in the ink jet printer according to a first embodiment of the present invention.
Figure 4B:
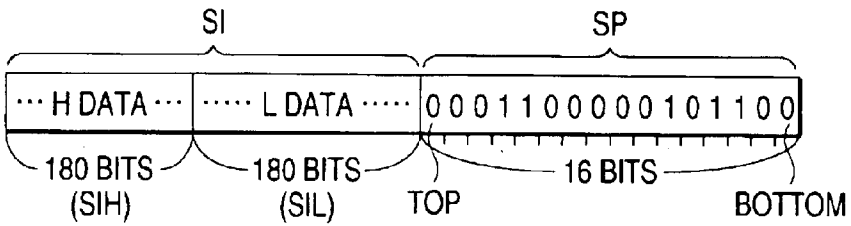
Figure 5:
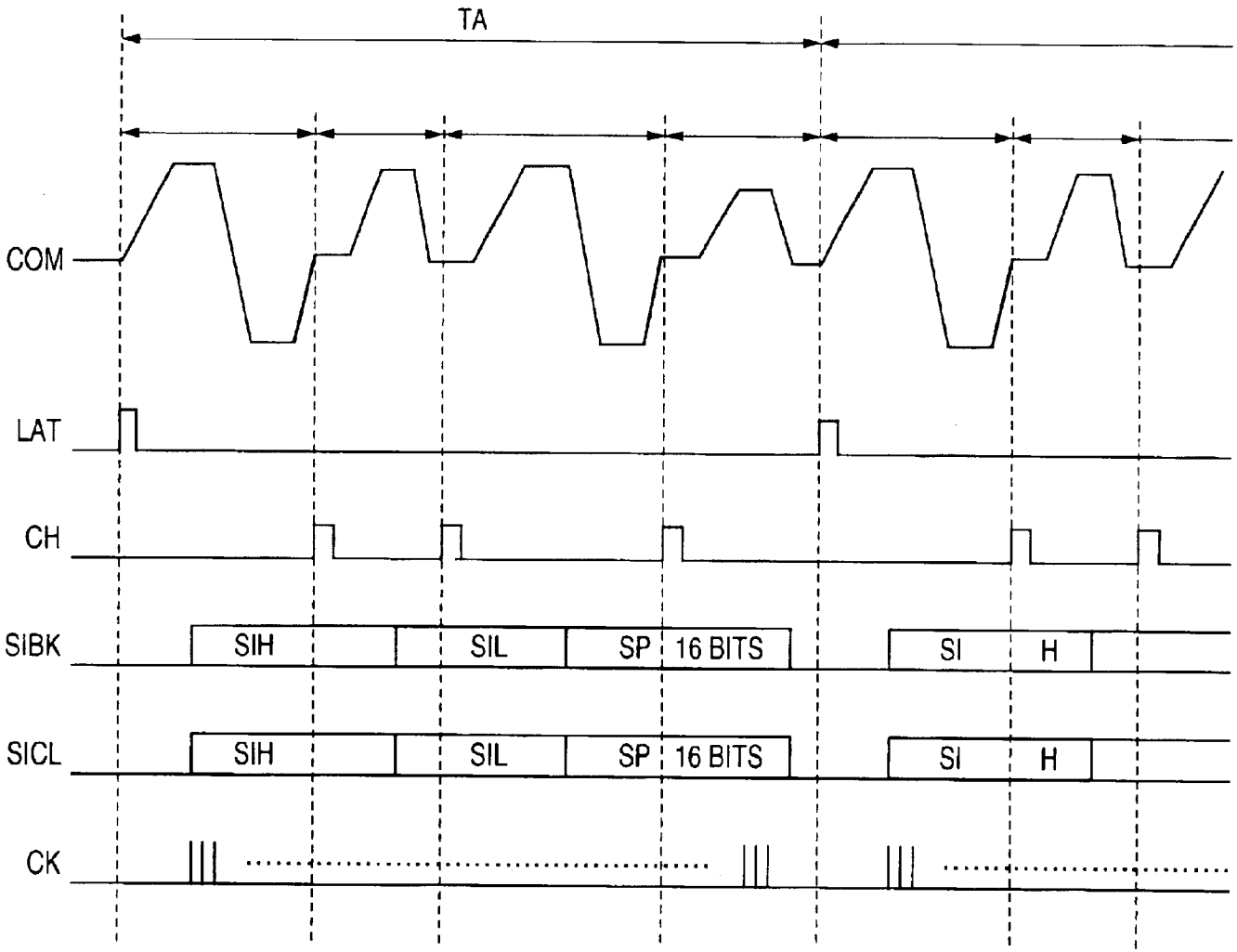
FIG. 5 is a timing chart for representing a relationship between the respective drive pulses of the drive signals and transfer timing of both the jetting data and the program (pattern) data.

As indicated in FIGS. 4 and 5, the drive signal generator 48 repeatedly generates the below-mentioned drive signal in the unit of a printing time period TA. In this drive signal, a first drive pulse DP1 for the middle dot (jetted ink droplet is approximately 13 pl), a second drive pulse DP2 for the small dot (jetted ink droplet is approximately 6 pl), a third drive pulse DP3 for the middle dot (jetted ink droplet is approximately 13 pl), and also, a fourth drive pulse DP4 for the meniscus vibration (no ink droplet is jetted) are arranged in this order.

Referring again to FIG. 3, the external I/F 43 receives from the host computer and the like, such printing data which is constituted by at least one of, for example, a character code, a graphic function, and image data. Also, the external I/F 43 outputs a busy signal (BUSY), an acknowledge signal (ACK), and the like with respect to the host computer.

The RAM 44 is used as an input buffer 44A, an output buffer 44C, a work memory 44B, and the like. The printing data which is received by the external I/F 43 from the host computer and the like is temporarily stored in the input buffer 44A. The jetting data SI serving as printed image data is prepared from the printing data supplied from the host computer (not shown) and the like, and is provided in the output buffer 44C to be transferred to each nozzle row of the printing head 10 in a serial manner. Hereinafter, the jetting data transferred to the nozzle row 10BK is referred as SIBK, and the jetting data transferred to the nozzle row 10CL is referred as SICL. The ROM 45 previously stores various sorts of control routines, various sorts of font data, various sorts of graphic functions, various kinds of procedures, and the like, which are executed by the control unit 46.

The control unit 46 serves as a data converter to convert the printing data into jetting data. In other words, while the control unit 46 reads out the printing data stored in the input buffer 44A to analyze the read printing data, the control unit 46 converts this analyzed printing data into jetting data having plural bits with reference to the font data, the graphic function, and the like, which have been previously stored in the ROM 45. It should be understood that such jetting data incorporated in this embodiment is constituted by 2-bit data, as will be discussed later. When this converted jetting data is stored in the output buffer 44C and then such jetting data corresponding to 1 (one) line of printing is acquired, this jetting data SI set for one line is transferred via the internal I/F 49 to the printing head 10 in a serial manner.

Also, the control unit 46 constitutes a portion of a timing signal generator to supply a latch signal (LAT) and a channel signal (CH) via the internal I/F 49. These latch signal and channel signal may define supply start timing as to the first drive pulse DP1 through the fourth drive signal DP4, which constitute the drive signal (COM).

The print engine 42 is arranged by the paper feeding mechanism 11, the carriage mechanism 12, and the printing head 10. As previously explained with reference to FIG. 1, the paper feeding mechanism 11 is constructed of a paper feeding motor (not shown), a paper feeding roller 26, and the like. This paper feeding mechanism 11 sequentially feeds out such a recording medium as the printing paper 150 so as to perform a sub-scanning operation. The carriage mechanism 12 is arranged by a carriage 30 used to mount thereon the printing head 10, a carriage motor 24, and the like. This carriage motor 24 drives, or travels this carriage 30 via a timing belt 36. This carriage mechanism 12 causes the printing head 10 to perform a main scanning operation.

Figure 6:
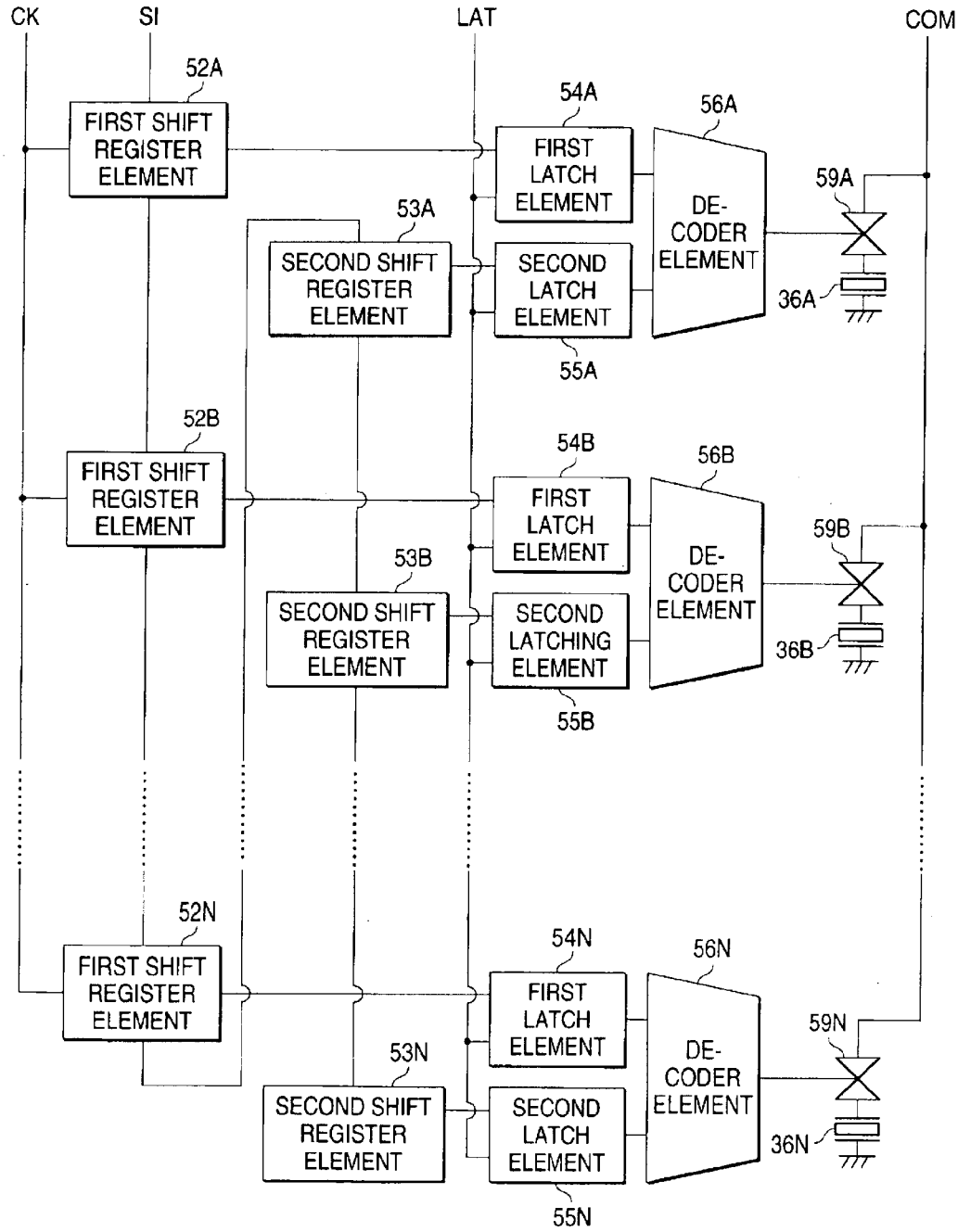
FIG. 6 is a block diagram showing a drive circuit of the printing head in the ink jet printer.

The printing head 10 is formed with the nozzle rows shown in FIG. 2, a pressure generating chamber, ink flow passages and a drive circuit 51. This drive circuit 51 of the printing head 10 is arranged by employing a shift register section, a latch section, a decoder 56, a control logic 57, a level shifter 58, a switcher 59, and a piezoelectric vibrator 36. The shift register section is constructed of both a first shift register 52 and a second shift register 53. The latch section is constructed of both a first latch 54 and a second latch 55. Then, plural sets of the respective shift registers 52 and 53, plural sets of the respective latches 54 and 55, plural sets of the decoders 56, plural sets of the switchers 59, and also, plural sets of the piezoelectric vibrators 36 are incorporated in correspondence with the respective nozzles (BK1, . . . , BK180, and Y1, . . . , Y60; M1, . . . , M60, C1, . . . , C60; see FIG. 2) of the black (BK) nozzle row 10BK and also the color (CL, i.e., Y, M, C) nozzle rows 10CL of the printing head 10. For example, as shown in FIG. 6, a drive circuit for each of the black (BK) nozzle row 10BK and also the color (CL, i.e., Y, M, C) nozzle rows 10CL is arranged by employing first shift register elements 52A to 52N; second shift register elements 53A to 53N; first latch elements 54A to 54N, second latch elements 55A to 55N, decoder elements 56A to 56N; switcher elements 59A to 59N; and piezoelectric vibrators 36A to 36N. It should be understood that although the level shifter 58 (see FIG. 3) is omitted in this FIG. 6, plural sets of such level shifters 58 are similarly provided.

Then, the print head 10 jets ink droplets in response to the jetting data SI supplied from the printer controller 41. In other words, the jetting data SI supplied from the printer controller 41 is transferred in the serial mode from the internal I/F 49 to both the first shift register 52 and the second shift register 53 in synchronism with the clock signal (CK) generated from the oscillator 47. While this jetting data SI corresponds to 2-bit data, this 2-bit data is constituted by gradation information indicative of four gradations consisted of "non-record", "small dot", "middle dot", and "large dot." As also apparent from FIG. 4A, in this embodiment, the "non-record" gradation corresponds to gradation information (00), the "small dot" gradation corresponds to gradation information (01), the "middle dot" information corresponds to gradation information (10), and also, the "large dot" gradation corresponds to gradation information (11).

The jetting data SI is set with respect to each of the nozzles (BK1, . . . , BK180; Y1, . . . , Y60, M1, . . . , M60, and C1, . . . C60; see FIG. 6). Then, as shown in FIGS. 4B and 5, as to all of the nozzles, such data having lower-order bits (L) are entered into the first shift register 52 (namely, first shift register elements 52A to 52N). Similarly, with respect to all of the nozzles, such data having higher-order bits (H) are inputted to the second shift register 53 (namely, second shift register elements 53A to 53N).

As indicated in FIG. 3, the first latch 54 is electrically connected to the first shift register 52, and the second latch 55 is electrically connected to the second shaft register 53. Then, when the latch signal (LAT) supplied from the printer controller 41 is entered into the respective first/second latches 54/55, the first latch 54 latches the data having the lower-order bits of the jetting data (SIL) indicated in FIG. 5, whereas the second latch 55 latches the data having the higher-order bits of the jetting data (SIH). Both a set of the first shift register 52 and the first latch 54, and another set of the second shift register 53 and the second latch 55, which are operated in the above-explained manner, constitute memory sections respectively. The respective memory sections temporarily store thereinto such jetting data SI before being entered into the decoder 56.

In this case, the drive signal (COM) generated by the drive signal generator 48 will now be explained. As shown in FIG. 4A, the drive signal generator 48 of this first embodiment may generate a series of drive signals in which the four drive pulses DP1 to DP4 are arranged within the printing time period TA, while these four drive pulses DP1 to DP4 define the different amounts of ink droplets.

This drive signal (COM) corresponds to such a signal having the first drive pulse DP1, the second drive pulse DP2, the third drive pulse DP3, and the fourth drive pulse DP4, which are repeatedly generated every printing time period TA. The first drive pulse DP1 is arranged in a time period "T1" (namely, first drive pulse DP1 is generated in time period T1). The second drive pulse DP2 is arranged in a time period "T2" after the time period "T1." The third drive pulse DP3 is arranged in a time period "T3" after the time period T2. The fourth drive pulse DP4 is arranged in a time period "T4" after the time period of T3. In this drive signal (COM), each of the first drive pulse DP1, the second drive pulse DP2, the third drive pulse DP3, and the fourth drive pulse DP4 owns such a waveform shape as indicated in FIG. 4A.

Since these first to fourth drive pulses DP1 to DP4 are supplied to the piezoelectric vibrator 36, predetermined amounts (approximately 13 pl, 6 pl, 13 pl, 0 pl) of ink droplets may be jetted from the nozzles of the printing head 10. In other words, in this case, both the first drive pulse DP1 and the third drive pulse DP3 own the same pulse shapes, and thus, may jet such ink droplets of the middle amount of approximately 13 pl. Since diameters of dots obtained by both the first drive pulse DP1 and the third drive pulse DP3 become on the order of middle sizes, these first drive pulse DP1 and third drive pulse DP3 may be expressed as "middle dot pulses." The second drive pulse DP2 is made of a smaller trapezoidal waveform than the trapezoidal waveforms of both the first drive pulse DP1 and the third drive pulse DP3. This second drive pulse DP2 may jet such small ink droplets of approximately 6 pl. Since a dot having a small diameter is obtained by this second drive pulse DP2, this second drive pulse DP2 may be represented as a "small dot pulse." The fourth drive pulse DP is employed so as to avoid an increase of viscosity of ink by vibrating the ink meniscus which is located in the vicinity of a center of each nozzle. None of ink droplets is jetted by this fourth drive pulse DP4. This fourth drive pulse DP4 may be expressed as a "meniscus vibration pulse."

Next, an arrangement for applying 4-bit pulse select information to the switcher 59 will now be explained with reference to FIGS. 4A and 4B.

First, 2-bit jetting data SI [H, L] with respect to each of these nozzles, which has been stored in the output buffer 44C is decoded into the above-explained 4-bit pulse select information [D1, D2, D3, D4] by the decoder 56 incorporated in the printing head 10. In this case, symbol D1 corresponds to a selection signal of the first drive pulse DP1, symbol D2 corresponds to a selection signal of the second drive pulse DP2, symbol D3 corresponds to a selection signal of the third drive pulse DP3, and also, symbol D4 corresponds to a selection signal of the fourth drive pulses DP4. This 4-bit pulse select information is applied to the switcher 59 corresponding to each of the nozzles of the printing head 10 within one printing time period. It should also be noted that as shown in FIG. 5, the 2-bit jetting data SI as to all of the nozzles are transferred to the respective shift registers 52 and 53 within one printing time period, and then, are latched by the respective latches 54 and 55 in response to the next latch signal. That is to say, such jetting data SI which should be executed in a certain printing time period are transferred to the printing head 10 within a printing time period just before the certain printing time period.

Then, this transferred jetting data SI is decoded into 4-bit pulse select information in response to generation timing of the respective drive pulses. The generation timing of the respective drive pulses is detected by both channel signals (CH) and latch signals (LAT) shown in FIG. 5. In other words, the generation timing of the first drive pulse DP1 is detected by the latch signal (LAT); the generation timing of the second drive pulse DP2 is detected by the channel signal (CH1); the generation timing of the third drive pulse DP3 is detected by the channel signal (CH2); and the generation timing of the fourth drive pulse DP4 is detected by the channel signal (CH3), respectively.

When the generations of the respective drive pulses are detected, the decoder 56 outputs such a selection signal corresponding to the relevant pulse to the switcher 59. In other words, for instance, when the generation of the first drive pulse DP1 is detected by the latch signal (LAT), the decoder 56 outputs the data of the pulse select information D1 for every nozzle. When the generation of the second drive pulse DP2 is detected by the channel signal (CH1), the decoder 56 outputs the data of the pulse select information D2 for every nozzle. As a result, for instance, in the case that the value of the pulse select information D1 applied to the nozzle is equal to "1", since the piezoelectric vibrator 36 is contracted or expanded in response to the first drive pulse DP1, such ink droplets having an ink amount equal to approximately 13 pl are jetted from the relevant nozzle, and then, these ink droplets are impacted onto the recording paper, so that recording dots having the middle dots are formed thereon. On the other hand, as to the nozzle in which the value of the applied pulse select information D1 is equal to "0", the first drive pulse DP1 is not applied to the piezoelectric vibrator 36, so that this nozzle does not jet an ink droplet.

As explained above, in the case that the four stages of the dot gradation are carried out, as described in Japanese Patent Publication No. 10-81013A, since program (pattern) data SP corresponding to a truth table is entered into a combination circuit, or the like, both jetting data (gradation value) and drive pulses may be freely combined with each other. At this time, every time jetting data having a binary value is transferred, transfers of program (pattern) data SP having 16 bits may be conceived. FIG. 4B represents a structure of such 16-bit program (pattern) data SP. In other words, the program (pattern) data SP corresponds to such data for defining a relationship between the jetting data SI and the drive pulses DP1 to DP4 to be selected.

In this case, as indicated in FIG. 4A, this program (pattern) data SP is constituted by 16 bits from the most significant bit data (TOP) up to the least significant bit data (BOTTOM). Here, the jetting data 4 of the fourth drive pulse DP4 is assigned to the most significant bit data (TOP). Next, the jetting data 3, the jetting data 2 and the jetting data 1 of the fourth drive pulse DP4 are assigned to subsequent bit data of the program data SP in this order. Accordingly, as shown in FIG. 4B, the first 4-bit data of the program data SP becomes (0001). Next, the jetting data 4, the jetting data 3, the jetting data 2 and the jetting data 1 of the third drive pulse DP3 are assigned to subsequent bit data of the program data SP in this order. Accordingly, the second 4-bit data of the program data SP becomes (1000). After then, the jetting data of the second drive pulse DP2 and the first drive pulse DP1 are similarly assigned to the program data SP until the least significant bit data (BOTTOM) is fulfilled. As a result, as shown in FIG. 4B, 16-bit data made of "0001100000101100" is transferred as the program (pattern) data SP.

The order of data in the program data SP which defines a conversion relationship between the jetting data SI and the pulse select information (decoded information) corresponds to the time-sequence arranged order of the respective drive pulses DP1–DP4 in the drive signal COM, so that the drive data can be efficiently generated. Only if this condition is satisfied, the jetting data 1 of the first drive pulse DP1 may be assigned to the most significant bit data (TOP) so that the jetting data 4 of the fourth drive pulse DP4 is assigned to the least significant bit data (BOTTOM).

As indicated in FIG. 4A, pulse select information (decoded information) corresponding to the respective jetting data SI (H, L) can be obtained based upon this program (pattern) data SP. That is, as jetting data (00), pulse select information (0001) is obtained. As jetting data (01), pulse select information (0100) is obtained. Also, as jetting data (10), pulse select information (1000) is obtained. As jetting data (11), pulse select information (1010) is be obtained. These pulse select information is constituted by a plurality of bits in which the respective bits correspond to the respective drive pulses DP1 to DP4 constituting the drive signal COM.

Then, in response to contents of the respective bits (0 or 1) in the pulse select information, either the supply or the non-supply of the respective drive pulses with respect to the piezoelectric vibrator 36 is determined. In other words, the most significant bit of the pulse select information corresponds to the first drive pulse DP1, the second bit thereof corresponds to the second drive pulse DP2, the third bit thereof corresponds to the third drive pulse DP3, and the least significant bit thereof corresponds to the fourth drive pulse DP4, respectively. Then, in the case that the most significant bit of the pulse selection signal is equal to (1), the switcher 59 is brought into a connection condition for a time duration defined from a start of the time period T1 up to a start of the time period T2. Also, in the case that the second bit of the pulse selection signal is equal to (1), the switcher 59 is brought into a connection condition for a time duration defined from the start of the time period T2 up to a start of the time period T3. Also, in the case that the third bit of the pulse selection signal is equal to (1), the switcher 59 is brought into a connection condition for a time duration defined from the start of the time period T3 up to a start of the time period T4. Similarly, in the case that the least significant bit of the pulse selection signal is equal to (1), the switcher 59 is brought into a connection condition for a time duration defined from the start of the time period T4 up to a start of a time period T1 within the next printing time period TA.

As a result, the second drive pulse DP2 is supplied to the relevant piezoelectric vibrator 36 based upon the jetting data (01) of the small dot. Similarly, the first drive pulse DP1 is supplied to the relevant piezoelectric vibrator 36 based upon the jetting data (10) of the middle dot. Also, both the first drive pulse DP1 and the third drive pulse DP3 are supplied to the relevant piezoelectric vibrator 36 based upon the jetting data (11) of the large dot.

FIG. 5 is a timing chart for representing 16-bit program (pattern) data SP in connection with drive signals, namely for showing a transfer method of this program (pattern) data SP. As indicated in this drawing, the 16-bit program (pattern) data SP is constituted by 16-bit data subsequent to such jetting data SI constructed of higher-order 180-bit data (SIH) and lower-order 180-bit data (SIL). As represented in FIG. 3, this 16-bit program (pattern) data SP is transferred by way of such a signal line which is commonly used with the jetting data SI contained in the FFC 100 from the printer controller 41 incorporated in the printer main body to the printing head 10.

As indicated in FIG. 5, in this data transfer system, multi-gradation data are transferred in such a manner that the higher-order 180-bit data (SIH) and subsequently the lower-order 180-bit data (SIL) are transferred by using 180×2=360 clocks every nozzle row (in each of jetting data SIBK and SICL) of the black ink nozzle row 10BK and the color ink nozzle row 10CL. In this data transfer system, as to the jetting data SI, the black printing data SIBK and the color printing data SICL are transferred to the respective TG of the two-row head. Also, as to the program data SP, 16-bit data SPBK is transferred subsequent to the black printing data SIBK, and 16-bit data SPCL is transferred subsequent to the color printing data SICL. In this first embodiment, program (pattern) data SP which is commonly used for the respective two TG is transferred (SPBK is identical with SPCL). That is, the multi-gradation pattern becomes common pattern irrespective of such a fact as to whether color of ink corresponds to color, or black.

The control unit 46 converts printing data supplied from the host computer into jetting data SI constituted by 2-bit gradation information, and then, transfers the converted jetting data to the printing head 10 in a serial manner.

For instance, the control unit 46 converts the printing data into the jetting data of the non-print (gradation information "00"), the jetting data of the small dot (gradation information "01"), the jetting data of the middle dot (gradation information "10"), or the jetting data of the large dot (gradation information "11"). The converted jetting data is transferred as the jetting data SI for one nozzle row, namely, this jetting data SI is constructed of both the higher-order 180-bit data (SIH) and the lower-order 180-bit data (SIL). While program data SP is constituted by such 16-bit data subsequent to 360-bit data SI, as indicated in FIG. 3, this program data SP is transferred from the printer controller 41 by way of such a signal line which is commonly used with the jetting data SI contained in the FFC 100.

The multi-gradation data SISP which is constituted by the jetting data jetting data SI and the program data SP is latched by the latches 54 and 55 at the timing of the latch signal after the jetting data SI has been set to the shift registers 52 and 53 of the printing head 10. On the other hand, the program data SP of this multi-gradation data SISP corresponds to such a data capable of defining a relationship between the jetting data SI and the selected drive pulses DP1 to DP4, and is transferred in the serial manner subsequent to the jetting data SI to the printing head 10. After this program data SP is set to a third shift register 60, the program data SP is determined by receiving the latch signal LAT, and then, is entered into a control logic 57. As this control logic 57, for example, such a known structure similar to the combination circuit and the like, as described in the Japanese Patent Publication No. 10-81013A, may be employed.

The jetting data latched by the respective latches 54 and 55 are entered into the decoder 56. This decoder 56 decodes the 2-bit jetting data so as to generate the pulse select information. While the above-explained pulse selection signal is entered from the control logic 57 into the decoder 56, the decoder 56 generates the pulse select information based upon this pulse selection signal.

The pulse select information decoded by the decoder 56 is inputted into the level shifter 58 in this order of the higher-order bits SIH every time such timing defined by the timing signal arrives. For example, at the first timing (start of time period T1) in the printing time period TA, the most significant bit data of the pulse select information is inputted into the level shifter 58, whereas at the second timing (start of time period T2), the second bit data of the pulse select information is entered into the level shifter 58. This level shifter 58 serves as a voltage booster. In the case that the pulse select information is (1), this level shifter 58 outputs such an electric signal having a voltage capable of driving the switcher 59, for example, boosted voltage of approximately several tens volts. The pulse select information (1) which has been boosted is applied to the switcher 59. While the drive signal COM generated from the drive signal generator 48 is supplied to the input side of this switcher 59, the piezoelectric vibrator 36 is connected to the output side of the switcher 59.

The pulse select information controls the operation of the switcher 59, namely, controls the selective supply of the first to fourth drive pulses DP1 to DP4 to the piezoelectric vibrator 36. For example, within such a time period during which the pulse select information applied to the switcher 59 is equal to (1), the switcher 59 is brought into the connection condition, so that this drive pulse is applied to the piezoelectric vibrator 36, and a potential level of the piezoelectric vibrator 36 is changed in response to this drive pulse. On the other hand, within such a time period during which the pulse select information applied to the switcher 59 is equal to (0), the level shifter 58 does not output such an electric signal capable of operating the switcher 59. As a result, the switcher 59 is deactivated, and thus, the drive pulse is not applied to the piezoelectric vibrator 36.

As a consequence, as shown in FIG. 4A, at least one of the first drive pulse DP1, the second drive pulse DP2, the third drive pulse DP3, and the fourth drive pulse DP4 can be selectively applied to the piezoelectric vibrator 36. As a result, the predetermined amounts (approximately 13 pl, approximately 6 pl, approximately 13 pl, and 0 pl) of the ink droplets can be jetted from the nozzles of the printing head.

In this embodiment, the program (pattern) data SP is constituted by the data subsequent to the jetting data SI, and is transferred by way of the signal line which is commonly used with the jetting data S1 within the FFC 100 from the printer controller 41 to the printing head 10. As a consequence, such a signal line used to transfer the program (pattern) data SP need not be separately provided, so that a total number of signal lines incorporated in the FFC 100 can be reduced.

Next, an ink jet printer according to a second embodiment of the present invention will now be explained. Since a basic structure of this ink jet printer according to this embodiment is the substantially same as that of the first embodiment shown in FIGS. 2 and 3, detailed explanations thereof are omitted.

Figure 7A:
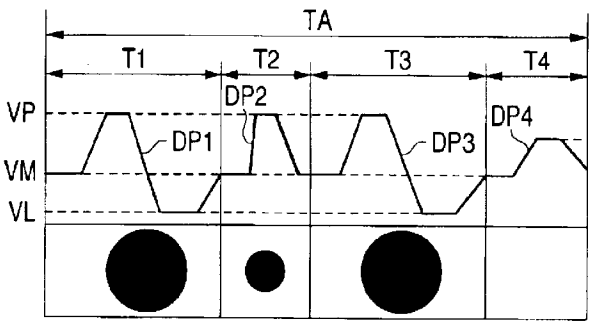
FIGS. 7A and 7B are diagrams for explaining a relationship among drive signals (pulses), jetting data, and program (pattern) data in the ink jet printer according to a second embodiment of the present invention.
Figure 7B:
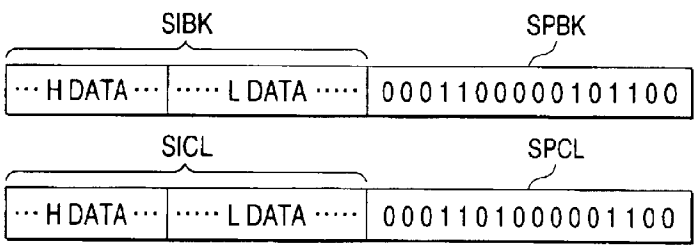

As represented in FIGS. 7A and 7B, the ink jet printer of this second embodiment is featured by that with respect to two TGs (transmission gates) of black ink and color ink, different program (pattern) data SP from each other are transferred (that is, SPBK is not equal to SPCL). In other words, multi-gradation patterns become different from each other, while colors of ink are black ink and color ink).

As represented in FIG. 7B, as the program (pattern) data SPCL of the color ink, such 16-bit data made of "0001100000101100" is transferred, whereas as the program (pattern) data SPBK of the black ink, another 16-bit data constructed of "0001101000001100" is transferred. In this case, as indicated in FIG. 7A, these program (pattern) data (SPCL and SPBK) are constituted by 16 bits defined from most significant bit data (TOP) up to least significant bit data (BOTTOM), as in the first embodiment.

As a consequence, first, based upon the program (pattern) data SPCL of the color ink, as shown in FIG. 7A, such pulse select information corresponding to the respective jetting data SPCL (H, L) is obtained. That is to say, as to the jetting data (00), pulse select information (0001) corresponding thereto is obtained. Also, as to the jetting data (01), pulse select information (0100) corresponding thereto is obtained. Also, as to the jetting data (10), pulse select information (1000) corresponding thereto is obtained. Further, as to the jetting data (11), pulse select information (1010) corresponding thereto is obtained.

On the other hand, based upon the program (pattern) data SPBK of the black ink as shown in FIG. 7A, such pulse select information corresponding to the respective jetting data SIBK (H, L) is obtained. That is to say, as to the jetting data (00), pulse select information (0001) corresponding thereto is obtained. Also, as to the jetting data (01), pulse select information (0010) corresponding thereto is obtained. Also, as to the jetting data (10), pulse select information (1000) corresponding thereto is obtained. Further, as to the jetting data (11), pulse select information (1010) corresponding thereto is obtained.

As apparent from a comparison result between FIG. 4 and FIG. 7, since both ink jetting control method and operations thereof executed based upon the jetting data SICL and the program (pattern) data SPCL of the color ink are completely similar to those of the above-described first embodiment, explanations thereof are omitted.

On the other hand, in the example shown in FIG. 7, as the program (pattern) data SPBK of the black ink, such 16-bit data made of "0001101000001100" is transferred. As a result, when the jetting data SIBK corresponds to (00), the fourth drive pulse DP4 equal to "meniscus vibration pulse" is selected, so that ink droplets are not jetted from the relevant nozzle, but also dots are not formed (non-recording operation). Also, when the jetting data SIBK corresponds to (01), the third drive pulse DP3 equal to "middle dot pulse" is selected, so that such ink droplets equivalent to approximately 13 pl are jetted from the relevant nozzle, the jetted ink droplets are impacted onto the recording paper, and thus, the recording dots of the middle dot size are formed in a relatively rear side in connection with the main scanning direction. Also, when the jetting data SIBK corresponds to (10), the first drive pulse DP1 equal to "middle dot pulse" is selected, so that such ink droplets equivalent to approximately 13 pl are jetted from the relevant nozzle, the jetted ink droplets are impacted onto the recording paper, and thus, the recording dots of the middle dot size are formed in a relatively front side in connection with the main scanning direction. Also, when the jetting data SIBK corresponds to (11), both the first drive pulse DP1 equal to "middle dot pulse," and the third drive pulse DP3 equal to "middle dot pulse" are selected, so that two sets of such ink droplets equivalent to approximately 13 pl are jetted from the same nozzle, these jetted ink droplets are impacted onto the recording paper, and thus, the recording dots of the large dot size are formed by being combined with each other.

As described above, in the ink jetting control operation based upon both the jetting data SIBK and the program (pattern) data SPBK of the black ink, the recording dots are formed in accordance with the pulse select information indicative of either recording operation or non-recording operation as to a former dot (in case of dot formed by first drive pulse DP1, namely unit pixel of front side) and also a latter dot (in case of dot formed by third drive pulse DP3, namely unit pixel of rear side) within one printing time period during which the recording control of the middle dot is carried out.

As a result, as apparent from FIG. 7A, the above-described ink jetting control is carried out in a similar to the following control operation. That is, while the higher-order bits of the jetting data SIBK are allocated to the former dot, the pulse select information indicates either recording of this former dot or non-recording of this former dot. Also, while the lower-order bits of the jetting data SIBK are allocated to the latter dot, the pulse select information indicates either recording of this latter dot or non-recording of this latter dot. For instance, the jetting data SIBK (00) implies that neither the former dot, nor the latter dot is recorded (0 pl). The jetting data SIBK (10) implies that only the former dot is recorded (13 pl front). The jetting data SIBK (11) implies that both the former dot and the latter dot are recorded in a continuous mode (26 pl).

Figure 8:
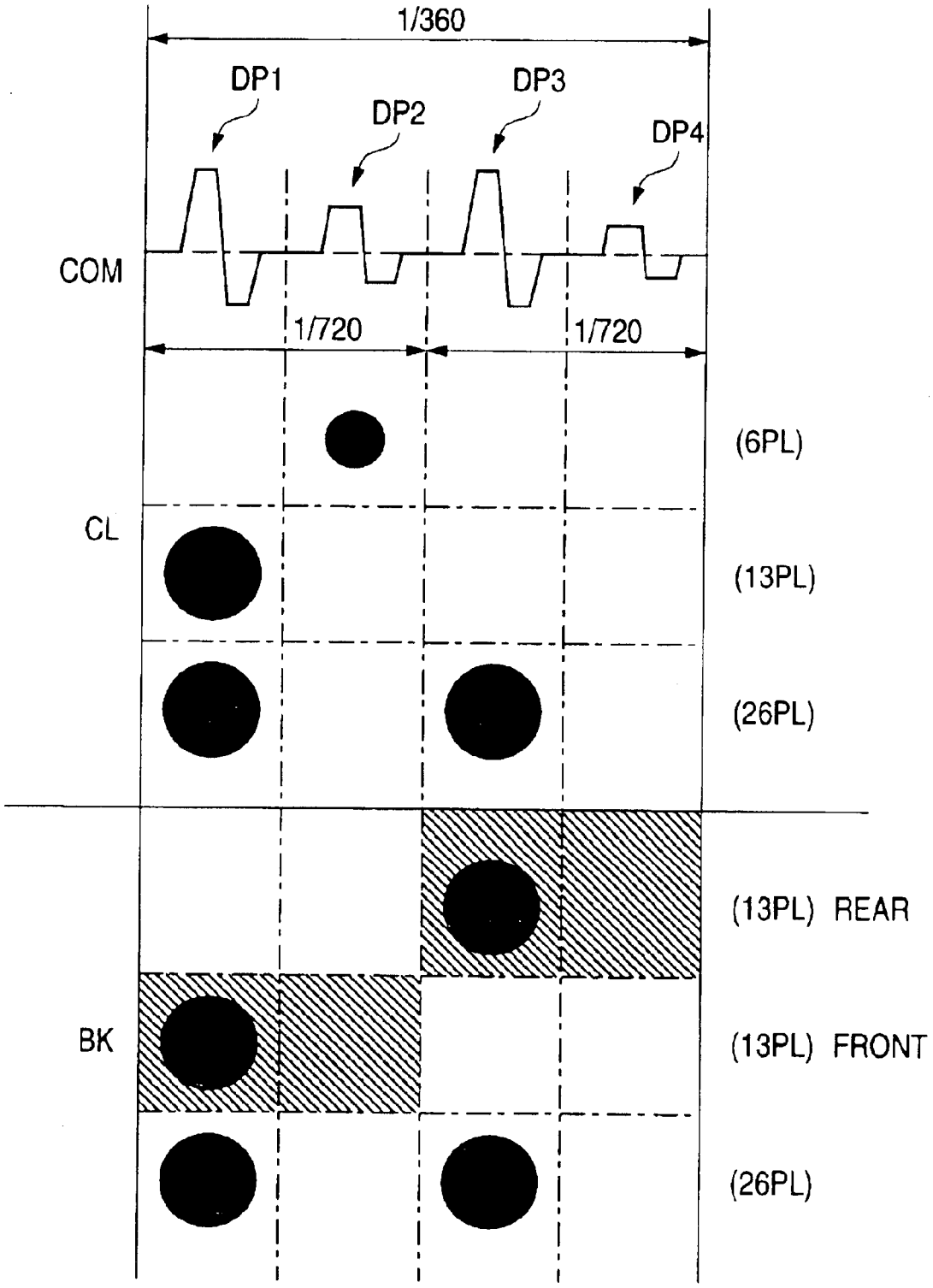
FIG. 8 is a diagram for explaining operations of the ink jet printer according to the second embodiment.

FIG. 8 is an explanatory diagram for explaining operations of the ink jetting type printer according to this embodiment. That is, FIG. 8 shows such a condition that ink droplets (6 pl, 13 pl, 26 pl) of color ink and ink droplets (13 pl rear, 13 pl front, 26 pl) of black ink are jetted respectively in accordance with the pulse select information shown in FIG. 7A so as to form dots.

More specifically, as indicated by a hatched portion as to the black ink (13 pl front, 13 pl rear) in FIG. 8, with respect to the black ink, two sets of unit pixels (high-resolution unit pixel) can be recorded within such a recording area corresponding to one printing time period TA (360 dpi) along the main scanning direction. Such a condition, as it were, can be established, in which the resolution along the main scanning direction is set to such resolution (720 dpi) two times higher than the resolution of color ink. In other words, in this case, the two high-resolution unit pixels as to the black ink can be recorded within the unit pixel forming region in the color ink.

As previously explained, in this embodiment, the different program (pattern) data SP are transferred to the two TGs of the black ink and the color ink. As a result, the programmable ink jetting operations can be carried out, for example, the resolution may be made different from each other as to the black ink and the color ink, respectively.

While the present invention has been described with reference to the specific embodiments, the present invention is not limited thereto, but may be applied to other embodiments within the technical scope defined in the accompanying claims of the present invention.

For instance, in the above-described embodiment, the printing head 10 is formed with the two types of nozzle rows, namely the nozzle row for jetting the black ink, and the nozzle row for jetting the color ink. However, the present invention is not limited to only two nozzle rows. For example, the present invention may be applied to such a case that 2-bit multi-gradation data is transferred by employing a printing head formed with seven rows of nozzles, each provided with 96 nozzles.

It should also be noted that the piezoelectric element has been employed as the pressure generating element in the above-described embodiments. However, the present invention is not limited to such a piezoelectric element, but a magnetostrictive element and the like may be employed. Furthermore, the present invention may be applied to a so-called bubble jet type ink jet printer, while a heat generating element is employed as the pressure generating element. The drive signal used for the bubble jet type printer has different waveforms from that for the piezoelectric vibrator, however, the subject matter of the invention is not essentially related to the waveform, but is related to how to constitute data for driving the pressure generating element.

What is claimed is:

1. An ink jet printer, comprising:

a control unit, which converts externally provided printing data into jetting data associated with a size of dot to be printed;

a drive signal generator, which generates a drive signal including a plurality of drive pulses;

a printing head, which includes:

a pressure chamber communicated with a nozzle;

a pressure generating element, which varies pressure inside of the pressure chamber when at least one of the drive pulses is applied;

a decoder, which decodes the jetting data into pulse select information in accordance with a predetermined conversion relationship; and a switcher, which selects at least one of the drive pulses to be applied to the pressure generating element in accordance with the pulse select information;

pattern data, which defines the conversion relationship; and a common signal line, which transfers the jetting data and the pattern data from the control unit to the printing head.

2. The ink jet printer as set forth in claim 1, wherein the pattern data is made continuous with the jetting data.

3. The ink jet printer as set forth in claim 1, wherein the jetting data consists of 2-bit data, and the pulse select information consists of 4-bit data.

4. The ink jet printer as set forth in claim 1, wherein the jetting data and the pattern data transfer through the common signal line within one printing time period.

5. The ink jet printer as set forth in claim 1, wherein the pattern data, which defines the conversion relationship, corresponds to data for defining a relationship between the jetting data and the plurality of drive pulses.

6. An ink jet printer, comprising:

a control unit, which converts externally provided printing data into jetting data associated with a size of dot to be printed;

a drive signal generator, which generates a drive signal including a plurality of drive pulses;

a printing head, which includes:

at least two nozzle rows, each associated with at least one color of ink and including a plurality of nozzles each communicated with a pressure chamber;

a pressure generating element, which varies pressure inside of the pressure chamber when at least one of the drive pulses is applied;

a decoder, which decodes the jetting data into pulse select information in accordance with a predetermined conversion relationship;

a switcher, which selects at least one of the drive pulses to be applied to the pressure generating element in accordance with the pulse select information;

at least two pattern data, each associated with at least one color of ink different from one another and each defining the conversion relationship;

a common signal line, which transfers the jetting data and the pattern data from the control unit to the printing head.

7. The ink jet printer as set forth in claim 6, wherein the pattern data is made continuous with the jetting data.

8. The ink jet printer as set forth in claim 6, wherein the jetting data consists of 2-bit data, and the pulse select information consists of 4-bit data.

9. An ink jet printer, comprising:

a control unit, which converts externally provided printing data into jetting data associated with a size of dot to be printed;

a drive signal generator, which generates a drive signal including a plurality of drive pulses;

a printing head, which includes:

at least two nozzle rows, each associated with at least one color of ink and including a plurality of nozzles each communicated with a pressure chamber;

a pressure generating element, which varies pressure inside of the pressure chamber when at least one of the drive pulses is applied;

a decoder, which decodes the jetting data into pulse select information in accordance with a predetermined conversion relationship;

a switcher, which selects at least one of the drive pulses to be applied to the pressure generating element in accordance with the pulse select information;

at least two pattern data, each associated with at least one color of ink different from one another and each defining the conversion relationship;

wherein:

the jetting data consisted of 2.m-bits data, and the pattern data consisted of 4.n-bits data are transferred from the control unit to the printing head within a unit printing time period; and m represents number of nozzles of each nozzle row, and n represents number of gradation capable of being printed.

10. The ink jet printer as set forth in claim 6, wherein:

the drive signal includes a first drive pulse associated with a first amount of jetted ink, a second drive pulse associated with a second amount of jetted ink which is less than the first amount, and a third drive pulse associated with the first amount of jetted ink; and at least one of the plural dot pattern data is so constructed as to select either one of the first drive pulse and the third drive pulse within a unit printing time period.

11. The ink jet printer as set forth in claim 6, wherein the jetting data and the pattern data transfer through the common signal line within one printing time period.

* * * * *